US006202322B1

(12) United States Patent
Turner, IV

(10) Patent No.: US 6,202,322 B1
(45) Date of Patent: Mar. 20, 2001

(54) AIR DISPENSING AND HEATING FLOOR DRYING APPARATUS

(76) Inventor: William Turner, IV, 16 Rufus St. #1, Pawtucket, RI (US) 02860

( * ) Notice: Subject to any disclaimer, the term of this patent is extended or adjusted under 35 U.S.C. 154(b) by 0 days.

(21) Appl. No.: 09/391,848

(22) Filed: Sep. 8, 1999

Related U.S. Application Data

(63) Continuation-in-part of application No. 08/895,750, filed on Jul. 17, 1997, now abandoned.

(51) Int. Cl.[7] ..... F26B 11/02
(52) U.S. Cl. ..... 34/618; 34/622
(58) Field of Search ..... 34/618, 621, 622, 34/614

(56) References Cited

U.S. PATENT DOCUMENTS 3,713,346 * 1/1973 Chamberlain et al. ..... 74/42
5,048,202 * 9/1991 Shero ..... 34/618
5,174,048 * 12/1992 Shero ..... 34/618
5,251,281 * 10/1993 Fravel ..... 392/384
5,257,467 * 11/1993 White ..... 34/618
5,367,739 * 11/1994 Johnson ..... 15/316.1
5,373,580 * 12/1994 Shao ..... 392/366

* cited by examiner

*Primary Examiner*—William Doerrler
(74) *Attorney, Agent, or Firm*—John D. Gugliotta

(57) ABSTRACT

An apparatus for drying damp carpet and flooring materials in either a heated or non-heated manner is disclosed. A blower is provided which incorporates coils located near or at the air flow entrance. A fan is included to produce the air. Designed for commercial carpet cleaning, the invention sits at floor level. The invention forces warm-to-hot air across the floor surface. A control is incorporated in the design to regulate the temperature of the forced air. A handle is designed with the housing of the blower on the top portion for carrying ease. The present invention rotates about a base to dry larger areas of flooring.

8 Claims, 6 Drawing Sheets

AIR DISPENSING AND HEATING FLOOR DRYING APPARATUS

RELATED APPLICATIONS

The present invention is a continuation in part of the application Ser. No. 08/895,750, filed on Jul. 17, 1997, now abandoned.

BACKGROUND OF THE INVENTION

1. Field of the Invention

The present invention relates generally to air blowers and, more particularly, to an air dispensing and heating floor drying apparatus.

2. Description of the Related Art

In the related art, many air blower and air heater devices have been improved and disclosed. However, none of the inventions of the prior art allow for the drying of carpet from underneath the carpet, from above the carpet in a rotational drying pattern, and also use of the device as a conventional portable blower.

A search of the prior art did not disclose any patents that read directly on the claims of the instant invention; however, the following references were considered related:

| U.S. Pat. No. | Inventor | Issue Date |
|---|---|---|
| 5,257,467 | Lawrence W. White | Nov. 2, 1993 |
| 5,174,048 | William K. Shero | Dec. 29, 1992 |
| 5,048,202 | William K. Shero | Sep. 17, 1991 |
| D359,823 | Robert J. Buchness | Jun. 27, 1995 |

Of considerable relevance is U.S. Pat. No. 5,174,048, which discloses a carpet dryer similar in overall nature to the present invention. While a securing mechanism for maintaining the edge of a carpet on the upper surface of the air outlet portion of the device is incorporated into this invention in combination, other elements are different enough as to make the combination distinguished over this and other prior art.

SUMMARY OF THE INVENTION

It is therefore an object of the present invention to provide an improved carpet and flooring drying device that allows for the drying of carpet from underneath the carpet, from above the carpet in a rotational drying pattern, and also use of the device as a conventional portable blower.

It is another object of the present invention to provide an improved carpet and flooring drying device that can be used either as a conventional blower or a heated air blower.

It is a feature of the present invention to provide an improved air dispensing and heating floor drying apparatus that can be adapted for directional heating for such tasks as thawing frozen pipes.

It is another object of the present invention to provide a device that rotates to allow for drying of a large area of carpet, floor, etc.

Briefly described according to the preferred embodiment of the present invention, an apparatus for drying damp carpet and flooring materials in either a heated or non-heated manner is disclosed. Included in the apparatus is a blower which incorporates coils located near or at the air flow entrance. A fan is included to produce the air. Designed for commercial carpet cleaning, the invention sits at floor level.

The air nozzle is at floor level, as well. Useable for both carpet and uncarpeted floors, the invention forces warm-to-hot air across the floor surface. A control is incorporated in the design to regulate the temperature of the forced air. Designed with a handle on the top portion for carrying ease, the invention utilizes a squirrel cage motor. An insulated power cord is incorporated as is a transformer.

Placed at floor level, the invention forces warm-to-hot air across the floor surface to cause drying. Designed for commercial use, the invention provides a steady flow of heated air that cuts the time needed for complete drying of the floor. A fan forces air over the heated coils at the nozzle of the invention. The coils warm the air increasing the drying ability of the forced air. Temperature is regulated to produce air within a range of warm-to-hot. A handle at the top of the invention allows it to be maneuvered to direct air around the room and to other areas. It can also serve as a carrier for the invention.

Located on the bottom of the present invention and releasably secured to the upper portion of the present invention is a base. The base is a component of the present invention. The present invention is designed to automatically rotate on the attached base, in an arc of 360 degrees in the horizontal plane, when desired. This feature allows the present invention to dry a large area of floor without constant supervision and handling of the present invention. An electric motor and drive assembly, located inside of the base, rotates the upper portion of the present invention. Rotation control means control the speed of rotation of the upper portion of the present invention.

Advantages of the present invention are many that would make it beneficial to both consumers and manufacturer. The simple design blends in with existing product lines at the manufacturing level, and can be used in conjunction with existing tools and hardware products. Regulated coils heats forced-air to desired temperature to increase drying power, and the ability to select temperature level allows for best results. The insulated housing protects components as well as people and exterior surfaces from hot coil.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

The best mode for carrying out the invention is presented in terms of its preferred embodiment, herein depicted within the Figures.

1. Detailed Description of the Figures

Figure 1:
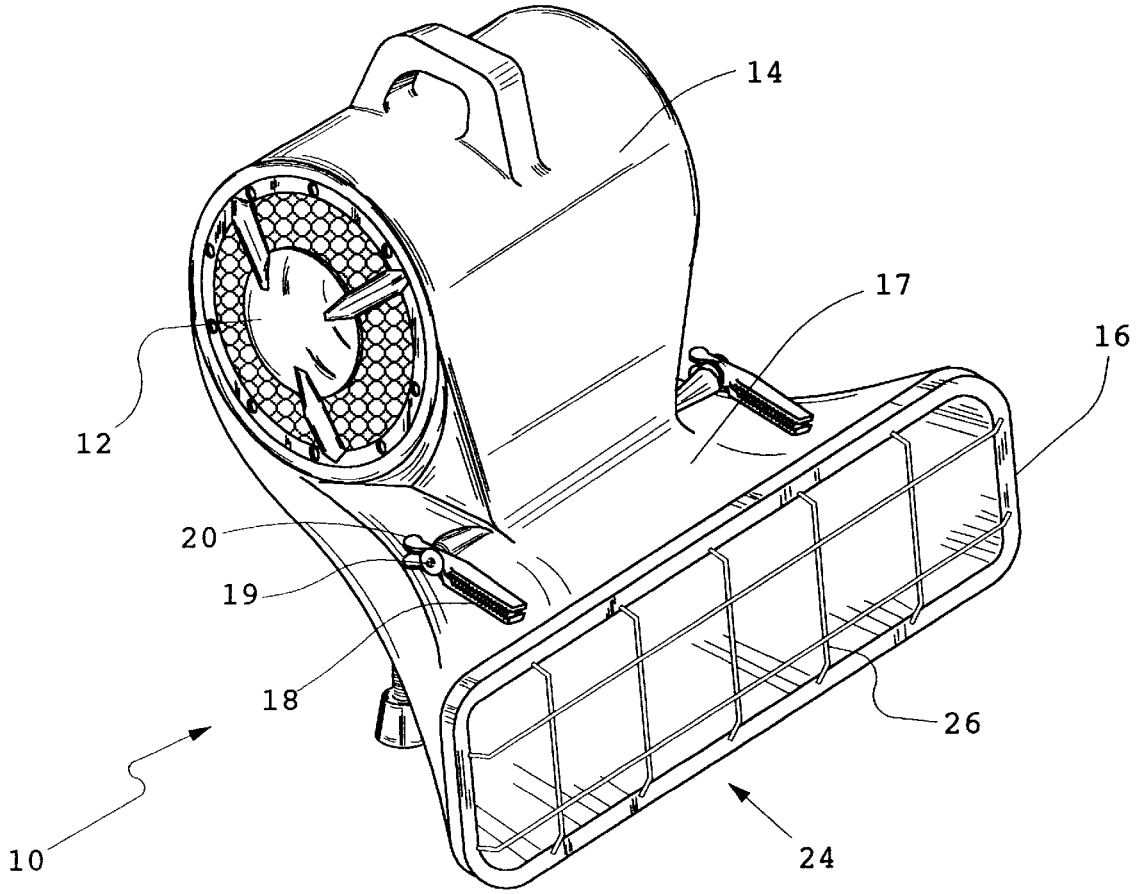
FIG. 1 is a perspective view of an air dispensing and heating apparatus designed for carpet and/or floor drying according to the preferred embodiment of the present invention.

Referring now to FIG. 1, an air dispensing and heating floor drying apparatus 10 is disclosed according to the preferred embodiment of the present invention. A multi-speed, blower motor 12 is housed within a blower housing 14 of insulated, plastic material. The blower motor 14 is in fluid communication with a discharge nozzle 16. The blower motor 14 is envisioned as of an otherwise conventional squirrel cage type, and is capable of drawing ambient air and delivering it in a projected fashion through a discharge nozzle 16. The discharge nozzle 16 forms a flat upper surface 17 and further includes a slightly flared configuration for allowing an outward dispersement of airflow discharged from the nozzle 16. The flat upper surface 17 is opposed to a spring clip 18. The spring clip 18 has a spring means 19 for generating a downward clamping force upon a clamp arm 20. It is envisioned that the outer edge of a rug or carpet can be clamped between the clamp arm 20 and the upper surface 17.

Also, air heating means is enclosed within the discharge nozzle 16. This is unlike existing carpet and flooring dryers, which merely discharge ambient temperature air, and can allow the present invention to have multiple functionality, such as space heating. In its preferred embodiment, it is envisioned that heating coils 24 are mounted within the annular space of the discharge nozzle 16. To accomplish the intended function it is felt that multiple temperature settings are required of a controllable heating coil, and that power ranges of between 20,000 BTU and 50,000 BTU are desirable. A protective guard 26 is required to cover the discharge nozzle outlet and the heating coils in order to prevent accident or injury that could occur by contact directly with the heating coils 24.

Figure 2:
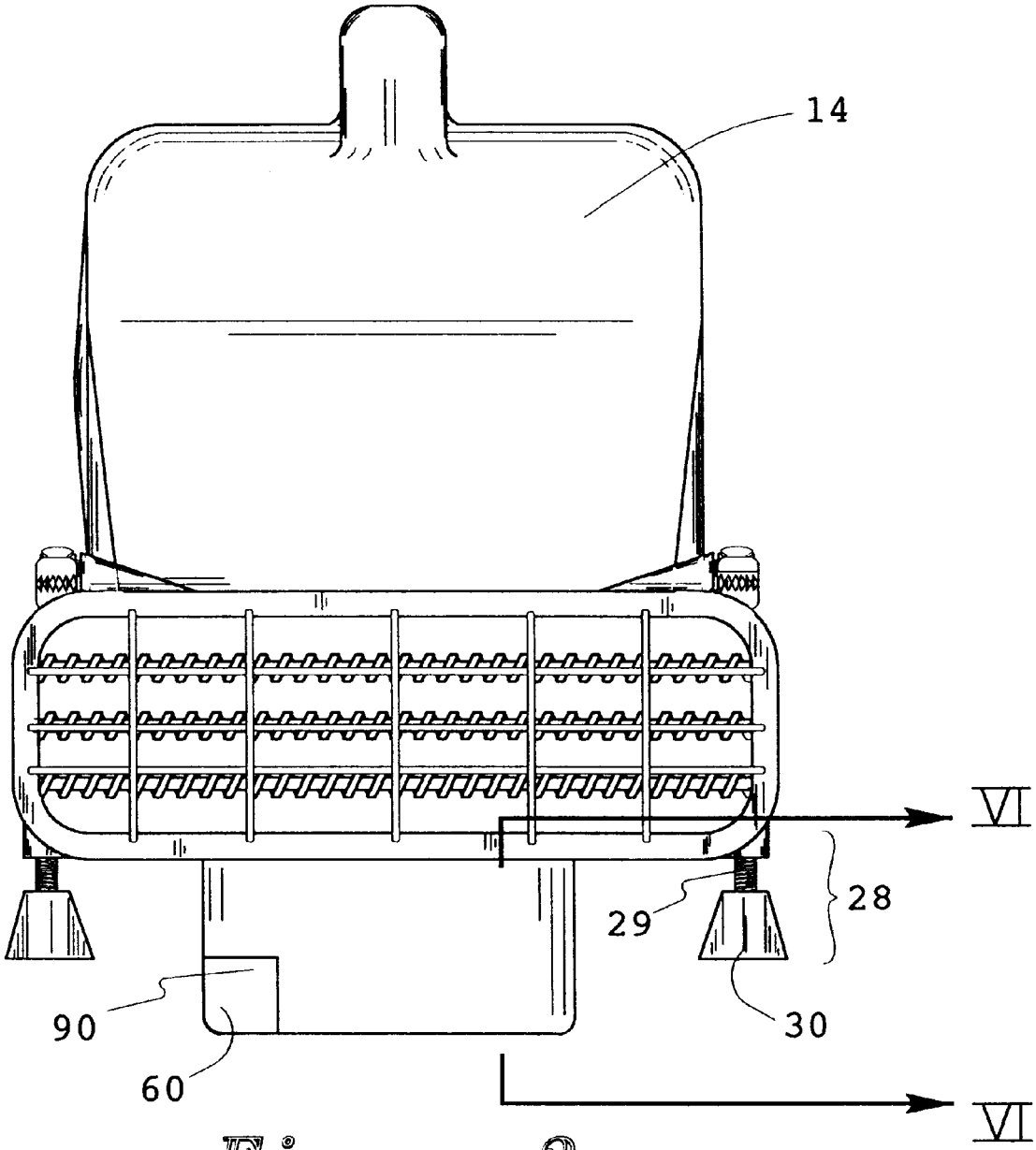
FIG. 2 is a front elevational view thereof.

Referring now to FIG. 2, a plurality of adjustable leg stands 28 are mounted along the bottom of the blower housing 14. Although many types of leg stands are widely known, it has been found that the ability to direct discharge airflow from the present invention is a desirable attribute; therefore, in its preferred embodiment a threaded rod 29 threadingly received within the housing 14 and terminated by a foot will adequately accomplish the present function.

Figure 3:
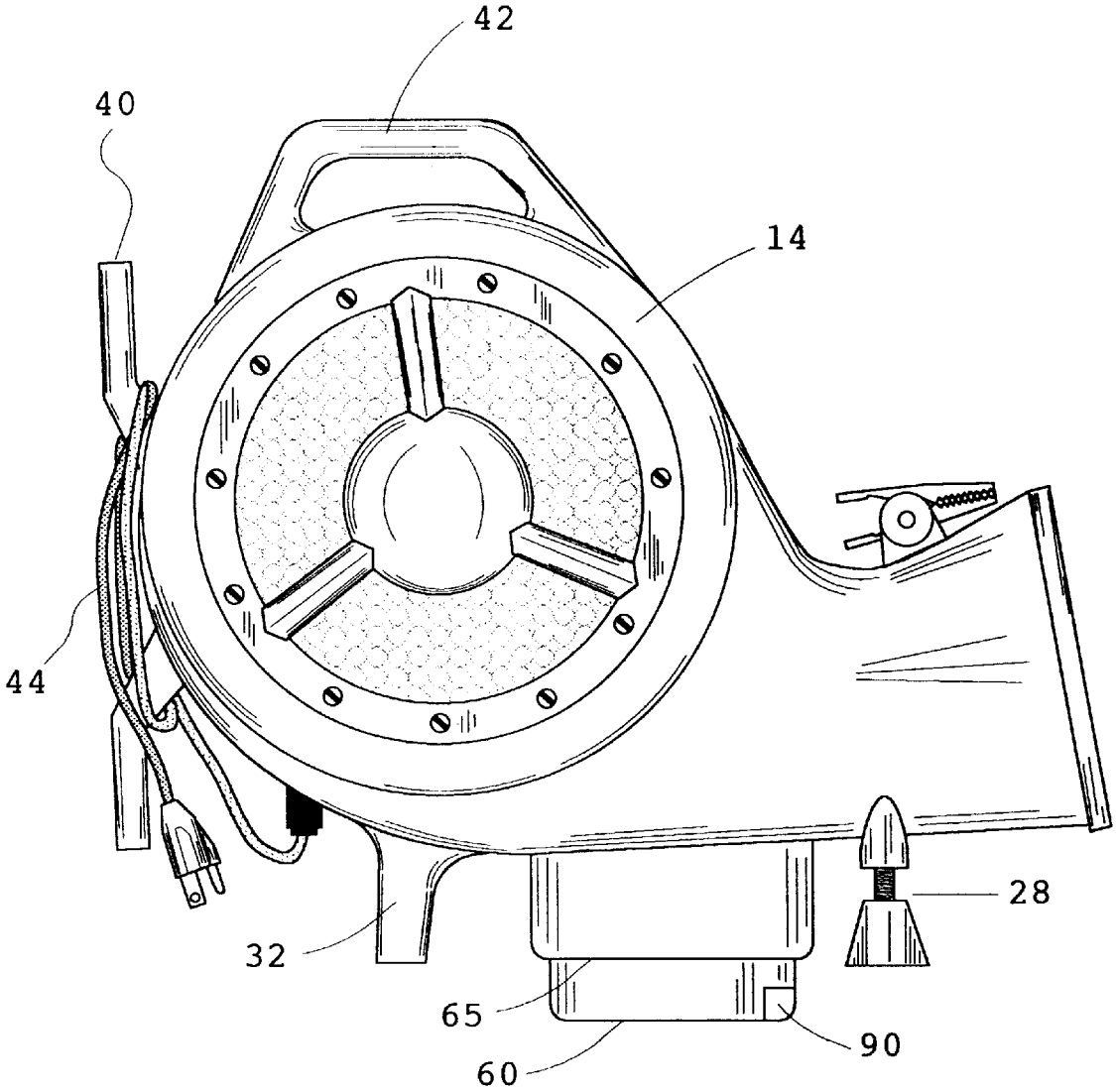
FIG. 3 is a side elevational view thereof.

In conjunction with FIG. 3, is envisioned that a fixed rear leg 32 in conjunction with an adjustable front leg 28 would adequately provide such functionality. However, adjustable front and rear legs would also accomplish this.

Figure 4:
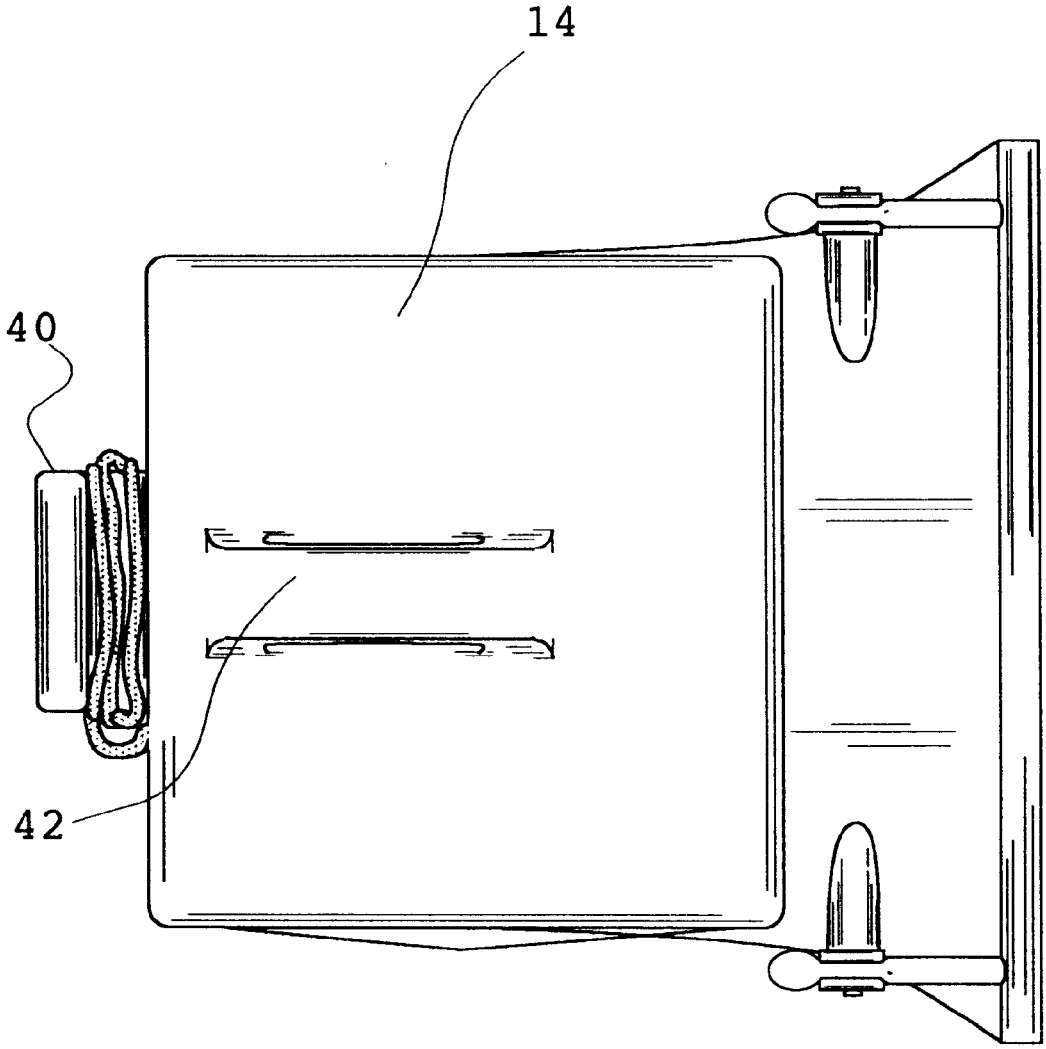
FIG. 4 is a top plan view thereof.

Referring to FIG. 3 and FIG. 4, a cord wrap 40 and handle 42 are shown incorporated directly into the design of the housing 14. The cord wrap 40 provides a means for storing a cord 44, provided to supply external electrical power to the blower motor 12. The handle 42 provides an ability to easily transport and maneuver the apparatus 10. Although other variations can be foreseen, the incorporation of the handle 42 and cord wrap 44 directly into the design of the housing 14 provides ease of manufacture and fewer overall components to the apparatus 10.

Figure 5:
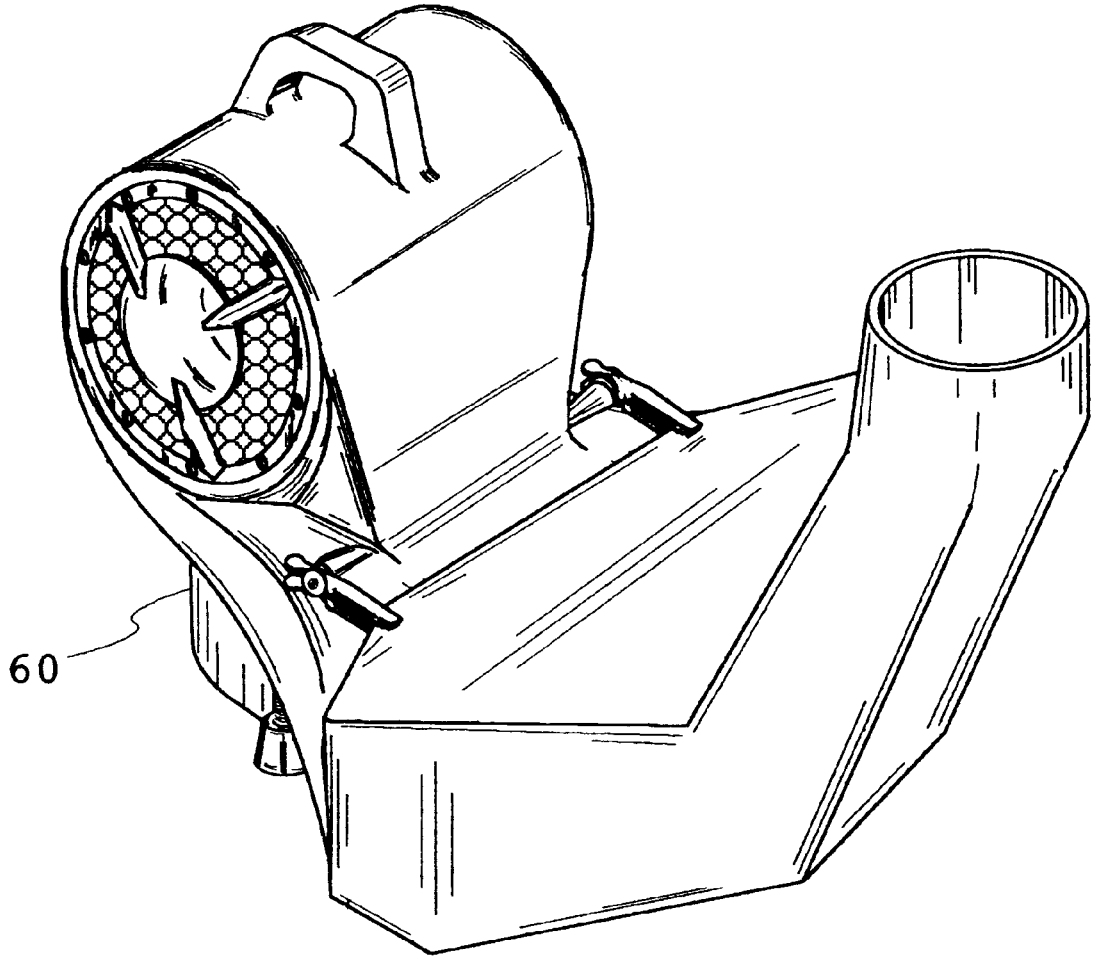
FIG. 5 is a perspective view of a frozen pipe defrosting attachment for use with the present invention.

Finally, in FIG. 5 directional discharge attachment means is depicted showing one particular embodiment for an attachment that affixes to the discharge nozzle 16 and provides a customized redirection of heated airflow. As conceived, various attachments would be useful, included, but not limited to, debris blowing attachments, frozen pipe heating attachments, space heating attachments, and the like.

Referring now to FIGS. 2, 3 and 5, located on the bottom of the present invention and releasably secured to the upper portion of the present invention is a base 60. The base 60 is a component of the present invention. Base securement means 65 connects the base 60 to the bottom of the blower housing 14.

The present invention is designed to automatically rotate on the attached base 60, in an arc of 360 degrees in the horizontal plane, when desired. This feature allows the present invention to dry a large area of floor without constant supervision and handling of the present invention.

Figure 6:
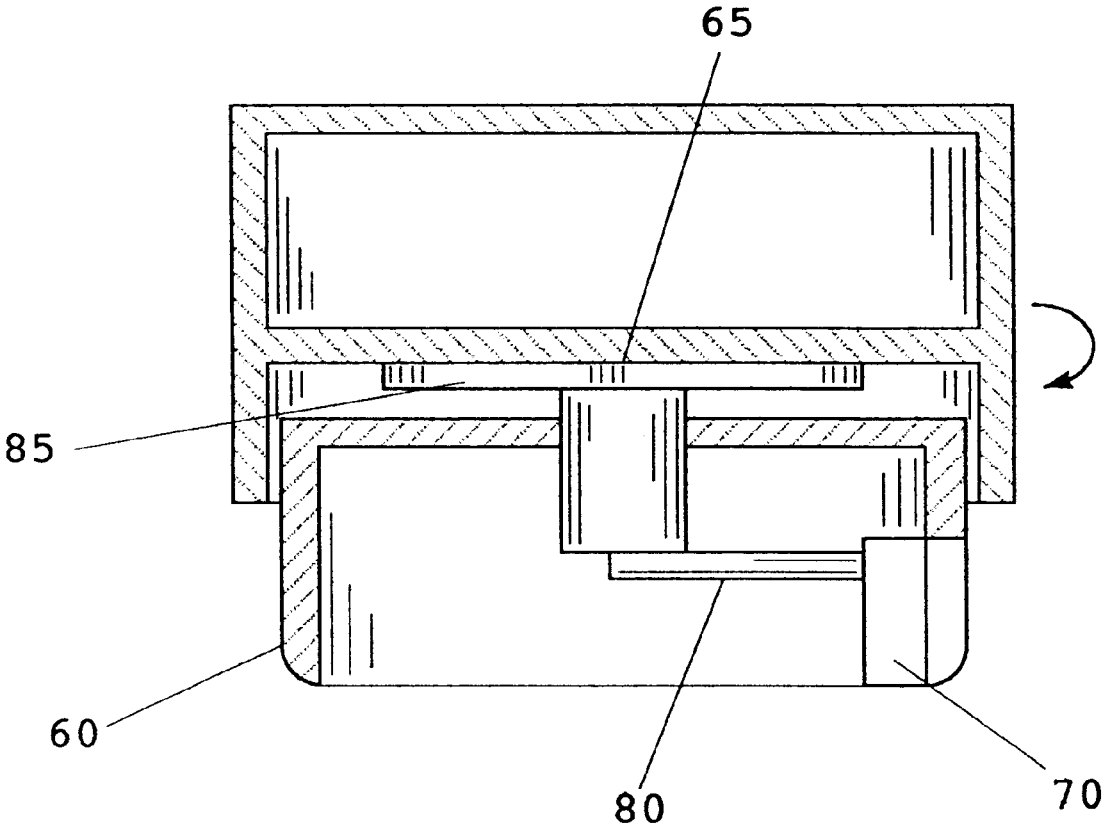
FIG. 6 is a cross-sectional view of the base cut along line VI—VI of FIG. 2.

Referring now to FIG. 6, an electric motor 70, and drive assembly 80, located inside of the base 60, rotates the upper portion of the present invention, including the blower housing 14. For purposes of disclosure, this rotation may be achieved via a turning carousel 85 located on the exterior top surface of the base 60, and slightly raised from the base 60, so that the bottom surface of the blower housing 14 rests on the carousel 85.

Referring now to FIGS. 2, 3 and 5, rotation control means 90 controls the speed of rotation of the upper portion of the present invention about the base 60.

2. Operation of the Preferred Embodiment

In operation, the present invention is utilized like an otherwise conventional flooring or carpet dryer. The apparatus 10 is maneuvered by the handle 42 to a required location, and the blower motor 12 and heating coils 24 adjusted to provide the appropriate and necessary amount of heated airflow. The rotation control means 90 may be used to rotate the blower housing 14 about the base 60.

The foregoing description is included to illustrate the operation of the preferred embodiment and is not meant to limit the scope of the invention. The scope of the invention is to be limited only by the following claims.

What is claimed is:

1. An air dispensing and heating floor drying apparatus comprising:

a multi-speed, blower motor is housed within a blower housing of insulated, plastic material, said blower motor being of an otherwise conventional squirrel cage type, and is capable of drawing ambient air and delivering it in a projected fashion;

a discharge nozzle in fluid communication with said blower motor through which said drawn ambient air is projected, and wherein said discharge nozzle forms a flat upper surface and further includes a slightly flared configuration for allowing an outward dispersement of airflow discharged from the nozzle;

a spring clip opposed to said flat upper surface, said spring clip including a clamp arm and tension means for generating a downward clamping force upon said clamp arm such that the outer edge of a rug or carpet can be clamped between the clamp arm and the upper surface;

air heating means enclosed within the discharge nozzle;

a protective guard covering the discharge nozzle outlet and the heating means in order to prevent accident or injury that could occur by contact directly with the heating means;

a base, said blower housing designed to rotate about said base in the horizontal plane in an arc of 360 degrees; and wherein rotation about said base may be achieved via a turning carousel, said carousel located on the exterior top surface of said base, and slightly raised from said base, so that the bottom surface of said blower housing rests on said carousel.

2. The air dispensing and heating floor drying apparatus of claim 1, wherein said heating means comprises heating coils mounted within the annular space of the discharge nozzle.

3. The air dispensing and heating floor drying apparatus of claim 1, wherein said heating coils is a controllable heating coil having multiple temperature settings capable of producing a thermal discharge in the ranges of between 20,000 BTU and 50,000 BTU.

4. The air dispensing and heating floor drying apparatus of claim 1, further comprising:

a plurality of adjustable leg stands mounted along the bottom of the blower housing.

5. The air dispensing and heating floor drying apparatus of claim 4, wherein said leg stands comprise a threaded rod threadingly received within the housing and terminated by a foot.

6. The air dispensing and heating floor drying apparatus of claim 1, further comprising:

a cord wrap incorporated directly into the design of the housing; and a handle incorporated directly into the design of the housing.

7. The air dispensing and heating floor drying apparatus of claim 1, further comprising:

directional discharge attachment means for affixing to the discharge nozzle and providing a customized redirection of heated airflow.

8. The air dispensing and heating floor drying apparatus of claim 1, further comprising rotation control means, said rotation control means designed to control the speed of rotation of said blower housing about said base.

* * * * *